US007898486B2

(12) United States Patent
Kim et al.

(10) Patent No.: US 7,898,486 B2
(45) Date of Patent: Mar. 1, 2011

(54) FRACTAL ANTENNA FOR VEHICLE

(75) Inventors: Jin-Ho Kim, Gyeonggi-do (KR); Dong-Won Lee, Gyeonggi-do (KR)

(73) Assignee: Mototech Co., Ltd., Siheung-si, Gyeonggi-do (KR)

( * ) Notice: Subject to any disclaimer, the term of this patent is extended or adjusted under 35 U.S.C. 154(b) by 384 days.

(21) Appl. No.: 12/183,060

(22) Filed: Jul. 30, 2008

(65) Prior Publication Data

US 2009/0174616 A1 Jul. 9, 2009

(30) Foreign Application Priority Data

Jan. 3, 2008 (KR) ..... 10-2008-000519

(51) Int. Cl.
*H01Q 1/32* (2006.01)
*H01Q 1/38* (2006.01)
*H01Q 1/42* (2006.01)

(52) U.S. Cl. ..... 343/713; 343/700 MS; 343/872

(58) Field of Classification Search ..... 343/711, 343/713, 700 MS, 872
See application file for complete search history.

(56) References Cited

U.S. PATENT DOCUMENTS 6,552,690 B2 * 4/2003 Veerasamy ..... 343/713
6,870,507 B2 * 3/2005 Anguera Pros et al. ..... 343/700 MS
7,202,818 B2 * 4/2007 Anguera Pros et al. ..... 343/700 MS
7,388,549 B2 * 6/2008 Chiang ..... 343/713
2010/0026590 A1 * 2/2010 Chiang et al. ..... 343/702

* cited by examiner

*Primary Examiner*—Shih-Chao Chen
(74) *Attorney, Agent, or Firm*—LRK Patent Law Firm

(57) ABSTRACT

Disclosed herein is a fractal antenna for a vehicle. First and second radiation elements are downwardly inclined from an apex ridge, and disposed opposite each other on the left and right sides inside a radome for protecting the antenna. First and second parasitic elements are formed in an inner space which is formed by the first and second radiation elements. Further, the first and second parasitic elements are disposed to be parallel to and spaced apart from the respective first and second radiation elements at regular intervals, are downwardly inclined from an apex ridge, and are disposed opposite each other on the left and right sides. The first and second radiation elements are respectively formed on part of the upper surface of a first substrate and part of the upper surface of a second substrate in patterns each having a predetermined shape.

24 Claims, 8 Drawing Sheets

[Fig 1]
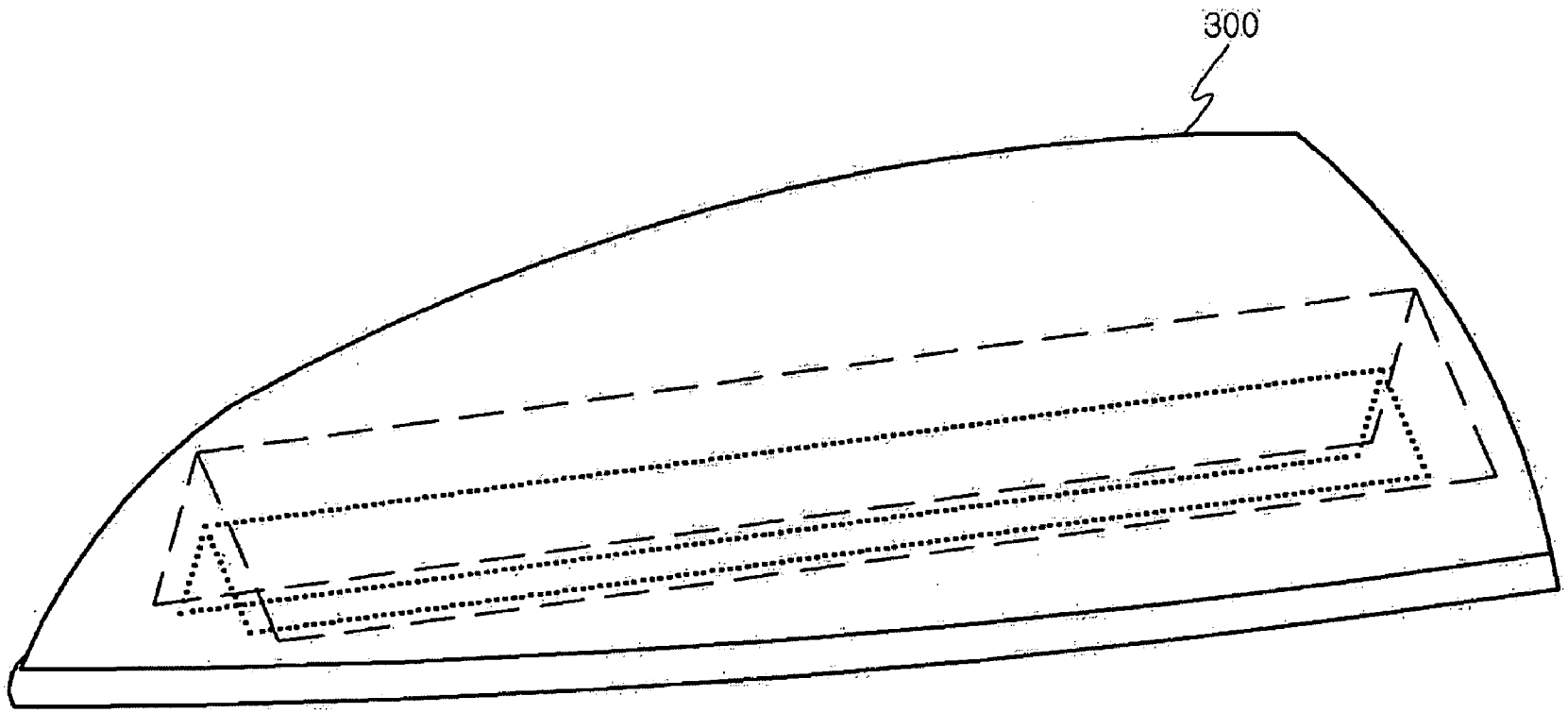

[Fig 2]
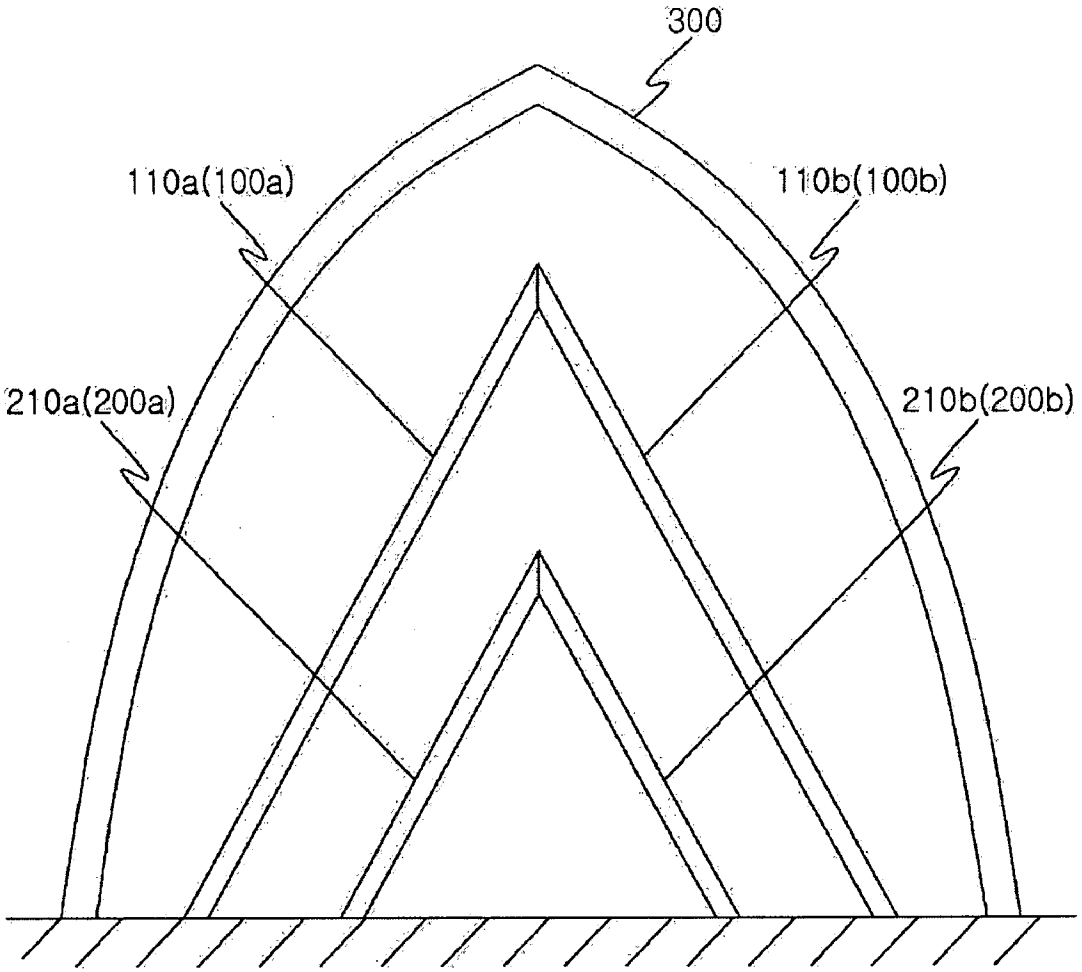

[Fig 3]
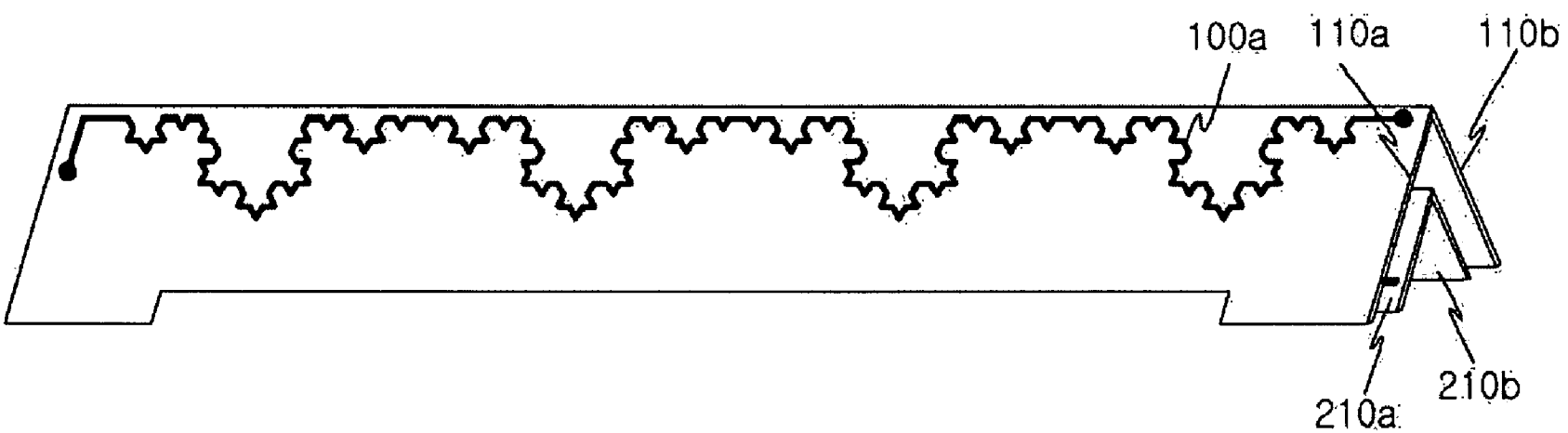

[Fig 4]
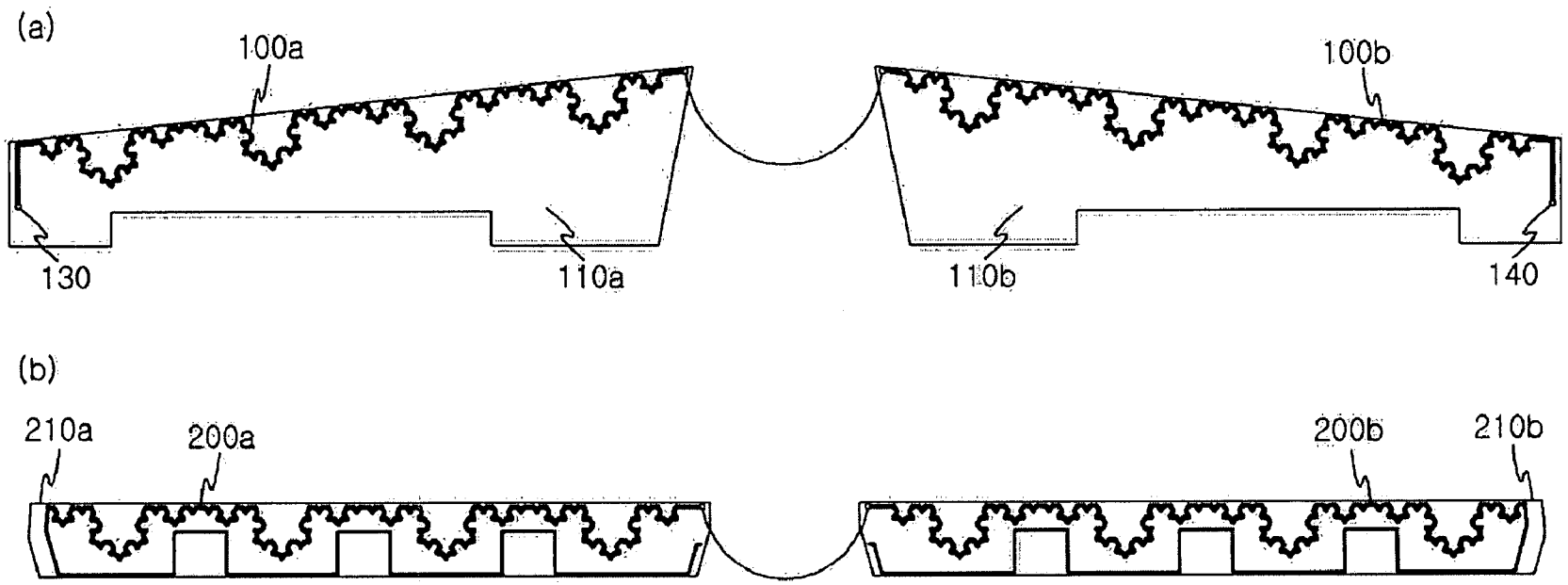

[Fig 5]
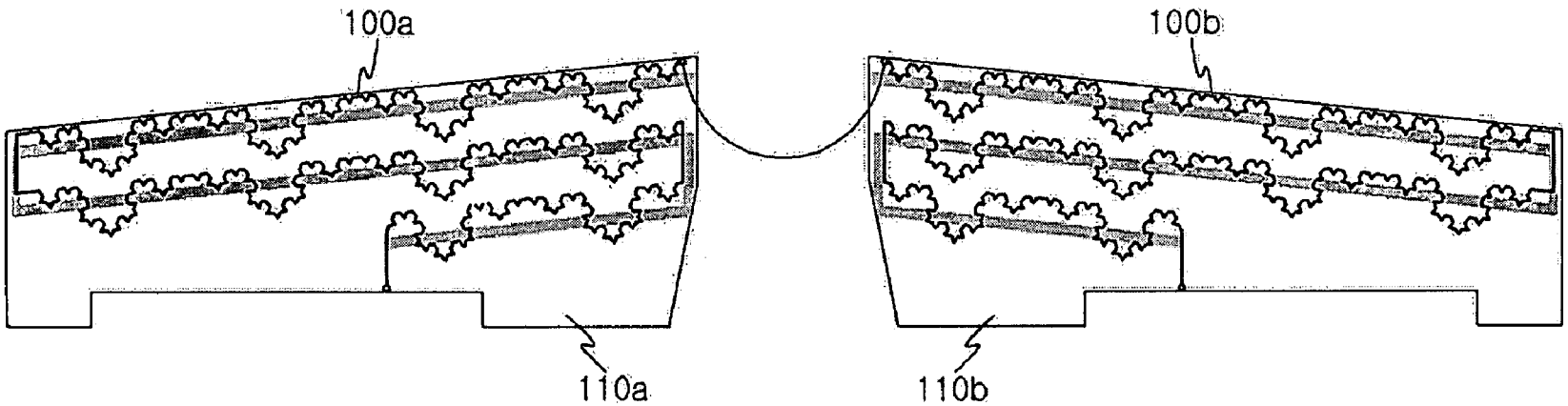

[Fig 6]
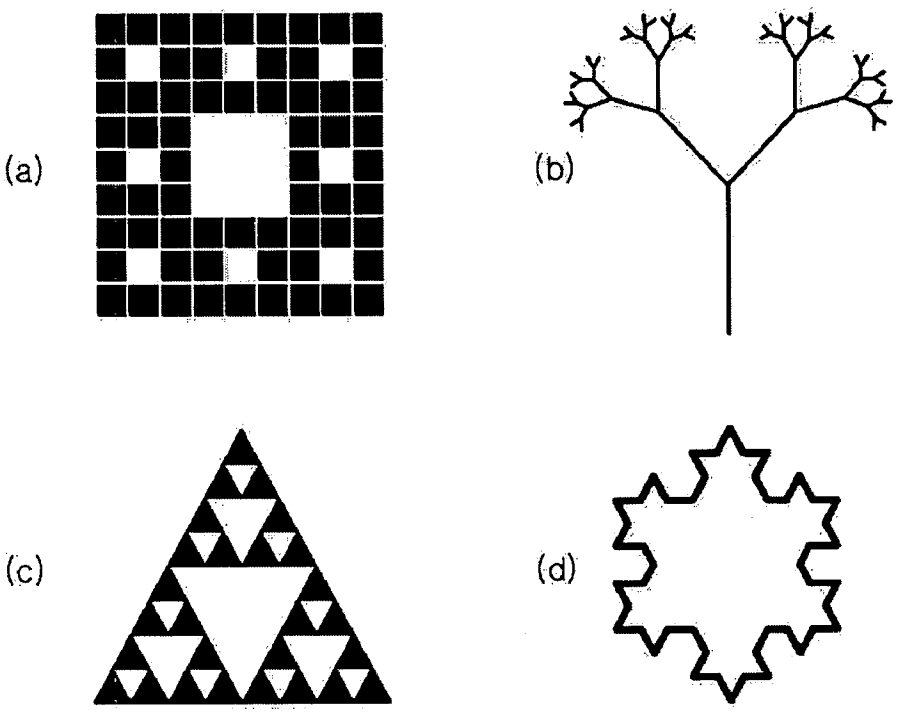

[Fig 7]
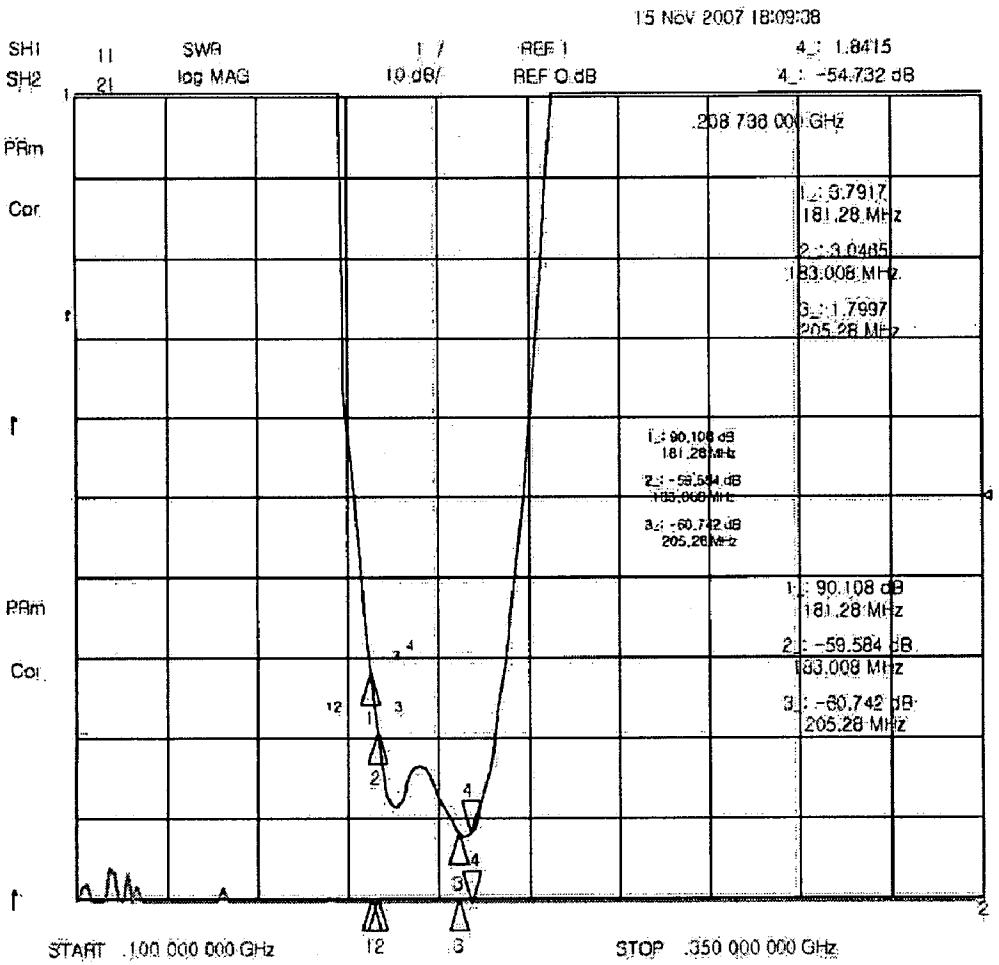

[Fig 8]
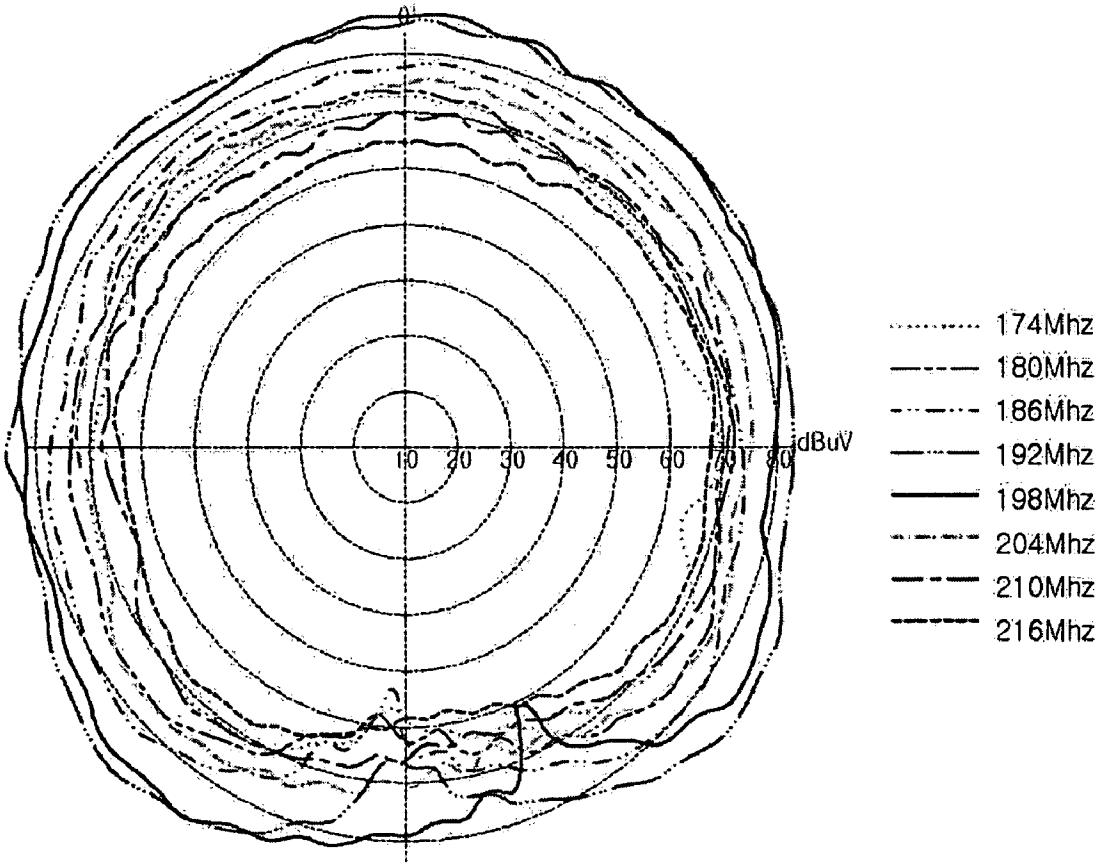

FRACTAL ANTENNA FOR VEHICLE

BACKGROUND OF THE INVENTION

1. Field of the Invention

The present invention relates generally to a fractal antenna for a vehicle, and more particularly, to a fractal antenna for a vehicle in which parasitic elements are disposed in an inner space formed by radiation elements, thereby generating broadband resonance frequencies, two radiation elements are disposed opposite each other on the left and right sides, thereby providing an omnidirectional antenna, and which uses a pattern having a fractal structure, so that space efficiency is improved, thereby reducing the size of the antenna.

2. Description of the Related Art

Generally, micro-strip patch antennas are currently most widely used as antennas used in land broadcasting, satellite broadcasting, and communication. However, such a micro-strip patch antenna has problems in that the efficiency thereof is considerably low, and the active management of bandwidth is difficult because the bandwidth is narrow, so that the center frequency of the bandwidth changes depending on variations in the surrounding environment.

Further, a conventional antenna has been manufactured using a method of printing an antenna pattern on part of a printed circuit board, on which a signal transmission/reception circuit and a data processing circuit are printed. In the case in which an antenna pattern is printed on a printed circuit board and an antenna is integrally provided, radiation patterns are not regular in all directions. Therefore, a problem occurs in that radiation efficiency for a specific direction is low, so that reception sensitivity is decreased. In order to perform mobile communication, such as the reception of Digital Multimedia Broadcasting (DMB) broadcasts and Amplitude Modulation/Frequency Modulation (AM/FM) broadcasts, communication must be performed in all directions, and thus it is considerably important for an antenna to have good omnidirectional characteristics in two dimensions.

In addition, when signals are received having a frequency bandwidth of which the central frequency is 200 MHz, such as DMB signals, the electrical length of a monopole antenna is generally 37.6 cm. The length of an AM/FM broadcasting antenna, which uses a lower frequency band than the DMB broadcasting antenna, is longer than that of the DMB broadcasting antenna. However, an antenna which has been conventionally used and has the appearance of a protruding structure, has problems in that it is undesirable in safety and appearance, it is inconvenient, and may be damaged when a vehicle is washed.

Therefore, a realistic, practical solution, which can reduce the size of an antenna by acquiring the electrical length of a radiation element in a limited space, has good omnidirectional characteristics so as to be suitable to receive DMB and AM/FM broadcasts, and which can realize broadband characteristics by optimizing the performance of the antenna, is seriously required.

SUMMARY OF THE INVENTION

Accordingly, the present invention has been made keeping in mind the above problems occurring in the prior art, and an object of the present invention is to provide a fractal antenna for a vehicle, in which first and second parasitic elements are disposed in an inner space formed by first and second radiation elements, so that the radiation elements and the parasitic elements are connected to each other in a coupling fashion, with the result that compensation is performed on a capacitance value, thereby generating broadband resonance frequencies.

Another object of the present invention is to provide a fractal antenna for a vehicle, in which the first and second radiation elements are disposed opposite each other on left and right sides, thereby providing an omnidirectional antenna, the signal attenuation of which is small in all directions.

Still another object of the present invention is to provide a fractal antenna for a vehicle, which uses a fractal structure pattern, so that space efficiency is improved, thereby providing an antenna that is further reduced in size.

In order to accomplish the above object, the present invention provides a fractal antenna for a vehicle, including first and second radiation elements downwardly inclined from an apex ridge, and disposed opposite each other on the left and right sides inside a radome for protecting the antenna; and first and second parasitic elements formed in an inner space formed by the first and second radiation elements, disposed to be parallel to and spaced apart from the respective first and second radiation elements at regular intervals, downwardly inclined from an apex ridge, and disposed opposite each other on the left and right sides.

In order to accomplish the above object, the present invention provides a fractal antenna for a vehicle including four substrates, that is, two pairs of substrates, a first pair of substrates being downwardly inclined from an apex ridge and disposed opposite each other on the left and right sides, and a second pair of substrates being downwardly inclined from an apex ridge and disposed opposite each other on the left and right sides; pattern units formed on the respective outer surfaces of the substrates; and a feed unit configured to apply signals to the pattern units.

In order to accomplish the above object, the present invention provides a fractal antenna for a vehicle including four substrates, that is, two pairs of substrates, a first pair of substrates being downwardly inclined from an apex ridge and disposed opposite each other on the left and right sides, and a second pair of substrates being downwardly inclined from an apex ridge and disposed opposite each other on the left and right sides; pattern units configured to have respective predetermined shapes, and formed on the respective outer surfaces of the substrates; a feed unit configured to apply signals to the pattern units; and a radome configured to protect the pattern units; wherein the substrates are disposed inside the radome so that a central axis between the first pair of substrates, which are downwardly inclined from an apex ridge and are disposed opposite each other on the left and right sides, and a central axis between the second pair of substrates, which are downwardly inclined from an apex ridge and are disposed opposite each other on the left and right sides, are perpendicular to the mounting surface of the vehicle.

Therefore, the present invention has an advantage in that the first and second parasitic elements are disposed in an inner space formed by the first and second radiation elements, so that the radiation elements and the parasitic elements are connected to each other in a coupling fashion, with the result that compensation is performed on a capacitance value, thereby generating broadband resonance frequencies.

Further, the fractal antenna for a vehicle according to the present invention provides an omnidirectional antenna in which the first and second radiation elements are disposed opposite each other on the left and right sides, so that signal attenuation is small in all directions.

In addition, the fractal antenna for a vehicle according to the present invention uses a fractal structure pattern, so that space efficiency is improved, thereby providing an antenna that is further reduced in size.

BRIEF DESCRIPTION OF THE DRAWINGS

The above and other objects, features and other advantages of the present invention will be more clearly understood from the following detailed description, taken in conjunction with the accompanying drawings, in which:

FIG. 1 is a perspective view showing a fractal antenna for a vehicle according to an embodiment of the present invention;

FIG. 2 is a cross-sectional view showing the fractal antenna for a vehicle according to the embodiment of the present invention;

FIG. 3 is a cubic view showing the fractal antenna for a vehicle according to the embodiment of the present invention;

FIG. 4 is a plan view showing the fractal antenna for a vehicle according to the embodiment of the present invention;

FIG. 5 shows examples of typical fractal structures;

FIG. 6 shows the structure of a radiation element of an AM/FM broadcasting fractal antenna for a vehicle according to an embodiment of the present invention;

FIG. 7 shows the characteristics of an antenna Voltage Standing Wave Ratio (VSWR) according to the embodiment of the present invention; and FIG. 8 shows the characteristics of an antenna radiation pattern according to the embodiment of the present invention.

DESCRIPTION OF THE PREFERRED EMBODIMENTS

Hereinafter, preferred embodiments of the present invention will be described in detail with reference to the attached drawings.

FIG. 1 is a perspective view showing a fractal antenna for a vehicle according to an embodiment of the present invention, and FIG. 2 is a cross-sectional view showing the fractal antenna for a vehicle according to the embodiment of the present invention.

The fractal antenna for a vehicle according to the embodiment of the present invention includes first and second radiation elements 100*a* and 100*b* and first and second parasitic elements 200*a* and 200*b*.

In further detail, as shown in FIGS. 1 and 2, the first and second radiation elements 100*a* and 100*b* and the first and second parasitic elements 200*a* and 200*b* are installed inside a radome 300, which protects the antenna and is installed upright on the mounting surface of a vehicle.

Inside the radome 300, the first and second radiation elements 100*a* and 100*b* are downwardly inclined from an apex ridge and are disposed opposite each other on the left and right sides. Further, in an inner space formed by the first and second radiation elements 100*a* and 100*b*, the first and second parasitic elements 200*a* and 200*b* are disposed to be parallel to and spaced apart from the respective first and second radiation elements 100*a* and 100*b* at regular intervals, are downwardly inclined from an apex ridge, and are disposed opposite each other on the left and right sides.

A central axis between the first and second radiation elements 100*a* and 100*b*, which are downwardly inclined from the apex ridge and are disposed opposite each other on the left and right sides, and a central axis between the first and second parasitic elements 200*a* and 200*b*, which are downwardly inclined from the apex ridge and are disposed opposite each other on the left and right sides, are disposed such that they are perpendicular to the mounting surface of the vehicle.

FIG. 3 is a cubic view showing the fractal antenna for a vehicle according to the embodiment of the present invention, and FIG. 4 is a plan view showing the fractal antenna for a vehicle according to the embodiment of the present invention.

As shown in FIGS. 3 and 4, the first and second radiation elements 100*a* and 100*b* are respectively formed on part of the upper surface of one side of a first substrate 110*a* and part of the upper surface of one side of a second substrate 110*b* in patterns each having a predetermined shape.

Each of the first and second substrates 110*a* and 110*b* is formed to have a predetermined size. Various types of modifications can be performed on the first and second substrates 110*a* and 110*b* depending on the shape of the radome 300, and the materials of the first and second substrates 110*a* and 110*b* can be easily changed to, for example, epoxy, plastics, Flame Retardant 4 (FR4), and Teflon for the use thereof.

The first and second radiation elements 100*a* and 100*b* are respectively formed on part of the upper surface of one side of the first substrate 110*a* and part of the upper surface of one side of the second substrate 110*b* in patterns each having a predetermined shape. In this embodiment, the first and second radiation elements 100*a* and 100*b* are each formed in such a way that a Koch curve fractal is periodically iterated.

An antenna having a fractal structure can be considerably smaller without decreasing its performance. Further, the fractal structure is used to obtain a multi-frequency band and applied to an antenna in order to increase the bandwidth around each frequency using the principle of self-similarity.

The self-similarity for an antenna shape can be obtained by performing flexion deformity or molding on a surface, by forming a fractal shape. In FIG. 5, various types of fractals are shown as examples. The fractal antenna can be formed using fractal shapes having various structures, such as a Sierpinski gasket, a Sierpinski carpet, a Minkovski patch, a Mandelbrot tree, a Koch curve, and a Koch island.

Although the Koch curve shape is employed in the embodiments of the present invention, the antenna according to the present invention can be formed using various fractal shapes, as described above.

A feed unit 130 is formed on one end of the first radiation element 100*a*. The feed unit 130 supplies power to the first and second radiation elements 100*a* and 100*b*.

An open end 140 is formed on one end of the second radiation element 100*a*.

The first and second radiation elements 100*a* and 100*b* are electrically connected to each other. Since the first and second radiation elements 100*a* and 100*b* are electrically connected to each other, the total length of the fractal antenna for a vehicle according to the present invention is the length of the pattern of the first radiation element 100*a* added to the length of the pattern of the second radiation element 100*b*.

A basic resonant frequency is adjusted based on the total length and width of the respective patterns of the first radiation element 100*a* and the second radiation element 100*b*. The total length of the patterns of the first radiation element 100*a* and the second radiation element 100*b* determines the resonant frequency, and the width of the patterns of the first radiation element 100*a* and the second radiation element 100*b* determines the resonance width of the resonant frequency.

The fractal antenna for a vehicle according to the present invention is operated in a DMB broadcast reception band or an AM/FM broadcast reception band based on the total length of the patterns which form the first and second radiation elements 100*a* and 100*b*.

In this embodiment, if the total length of the patterns of the first radiation element 100*a* and the second radiation element 100*b* is 38±2 cm, the antenna has the resonance characteristics of a band (174 to 216 MHz) that is suitable for DMB broadcast reception. In this case, each of the first and second radiation elements 100*a* and 100*b*, which are formed in a fractal shape, has a basic period length of 2 cm and is formed in a Koch curve shape having four periods together with four scales. The length of each of the patterns of the first and second radiation elements 100*a* and 100*b* is approximately 18.96 cm, and the total length of the first and second radiation elements 100*a* and 100*b* is 37.94 cm.

In this embodiment, if the total length of the patterns of the first radiation element 100*a* and second radiation element 100*b* is 95±2 cm, the antenna has the resonance characteristics of a band (88 to 108 MHz) that is suitable for FM broadcast reception. In this case, each of the first and second radiation elements 100*a* and 100*b*, which are formed in a fractal shape, has a basic period length of 2 cm and is formed in a Koch curve shape having ten periods together with four scales. The length of each of the patterns of the first and second radiation elements 100*a* and 100*b* is approximately 47.4 cm, and the total length of the first and second radiation elements 100*a* and 100*b* is approximately 94.8 cm. In addition, the first radiation element 100*a* and the second radiation element 100*b* generate resonance frequencies in an AM band (150 to 1750 KHz) using a buffer and amplifier by matching input impedance with high impedance.

The numerical values for the length of the patterns of the radiation elements are mentioned in the above-described embodiment by way of example, but the present invention is not limited thereto.

The pattern unit of an antenna such as an AM/FM broadcasting antenna, which uses a low frequency band, is long. As shown in FIG. 6, when the lengths of the first and second radiation elements 100*a* and 100*b* are respectively longer than the lengths of the first and second substrates 110*a* and 110*b*, the first and second radiation elements 100*a* and 100*b* are formed so as to be curved in the form of a meander line structure within the respective first and second substrates 110*a* and 110*b*, so that a single pattern is formed without being cut off.

The first and second parasitic elements 200*a* and 200*b* are respectively formed on part of the upper surface of one side of a third substrate 210*a* and part of the upper surface of one side of a fourth substrate 210*b* in patterns each having a predetermined shape, each of the third and fourth substrates being formed to have a predetermined size. The first and second parasitic elements 200*a* and 200*b* are electrically connected to each other.

Like the first and second radiation elements 100*a* and 100*b*, the first and second parasitic elements 200*a* and 200*b* are formed in such a way that a Koch curve fractal is periodically iterated.

The first radiation element 100*a* is connected to the first parasitic element 200*a* in a coupling fashion, and the second radiation element 100*b* is connected to the second parasitic element 200*b* in a coupling fashion, so that compensation is performed on a capacitance value 'C', thereby generating broadband resonance frequencies.

In an inner space, which is formed in such a way that the first and second radiation elements 100*a* and 100*b* are downwardly inclined from an apex ridge and are disposed opposite each other on the left and right sides, the first and second parasitic elements 200*a* and 200*b* are disposed to be parallel to and spaced apart from the respective first and second radiation elements 100*a* and 100*b*, and are disposed opposite each other on the left and right sides. In this embodiment of the present invention, the first and second parasitic elements 200*a* and 200*b* and the first and second radiation elements 100*a* and 100*b* are disposed while maintaining an optimized separation therebetween of 3 mm. The locations of the first and second parasitic elements 200*a* and 200*b* determine the amount of coupling.

FIG. 7 is a view showing the characteristics of an antenna VSWR according to the embodiment of the present invention.

As shown in FIG. 7, the frequency band of the fractal antenna for a vehicle according to the present invention is expanded by approximately 20 MHz, compared to the characteristics of a general-purpose micro-strip patch antenna.

Since the first and second radiation elements 100*a* and 100*b* are downwardly inclined from an apex ridge and are disposed opposite each other on the left and right sides, the fractal antenna for a vehicle has an omnidirectional radiation pattern.

FIG. 8 is a view showing the characteristics of an antenna radiation pattern according to the embodiment of the present invention.

As shown in FIG. 8, the fractal antenna for a vehicle according to the present invention provides an omnidirectional antenna, the signal attenuation of which is small in all directions.

A fractal antenna for a vehicle according to another embodiment of the present invention includes substrates 110*a* and 110*b* which are downwardly inclined from an apex ridge and are disposed opposite each other on the left and right sides (for an example, in a '∧' shape); substrates 210*a* and 210*b* which are downwardly inclined from an apex ridge and are disposed opposite each other on the left and right sides in an inner space formed by the substrates 110*a* and 110*b* and having the same shape as the substrates 110*a* and 110*b*; pattern units 100*a*, 100*b*, 200*a*, and 200*b* which have predetermined shapes and are formed on the respective outer surfaces of the substrates 110*a*, 110*b*, 210*a*, and 210*b*; and a feed unit 130 which applies signals to the four pattern units 100*a*, 100*b*, 200*a*, and 200*b*.

In further detail, the substrates 110*a* and 110*b* are downwardly inclined from the apex ridge and are disposed opposite each other on the left and right sides, and the substrates 210*a* and 210*b* are downwardly inclined from the apex ridge and are disposed opposite each other on the left and right sides. The substrates 110*a*, 110*b*, 210*a*, and 210*b* are disposed inside the radome 300, which protects the antenna, so that a central axis between the substrates 110*a* and 110*b* and a central axis between the substrates 210*a* and 210*b* is perpendicular to the mounting surface of the vehicle.

The substrates 110*a*, 110*b*, 210*a*, and 210*b* include outwardly disposed first and second substrates 110*a* and 110*b* and inwardly disposed third and fourth substrates 210*a* and 210*b*.

The pattern units 100*a*, 100*b*, 200*a*, and 200*b* include the first and second radiation elements 100*a* and 100*b*, which are formed on the respective first and second substrates 110*a* and 110*b* in such a way that a Koch curve fractal is periodically iterated, and are configured to radiate electromagnetic waves, and include the first and second parasitic elements 200*a* and 200*b*, which are formed on the respective third and fourth substrates 210*a* and 210*b* in such a way that a Koch curve fractal is periodically iterated, and are connected to the respective first and second radiation elements 100*a* and 100*b* in a coupling fashion.

The basic resonant frequency is adjusted based on the total length and width of the patterns, which form the first and second radiation elements 100*a* and 100*b*.

The fractal antenna for a vehicle according to the present invention is operated in a DMB broadcast reception band or an AM/FM broadcast reception band based on the total length of the patterns which form the first and second radiation elements 100*a* and 100*b*.

When the lengths of the first and second radiation elements 100*a* and 100*b*, formed in the fractal structure patterns, are longer than the respective lengths of the first and second substrates 110*a* and 110*b*, the first and second radiation elements 100*a* and 100*b* are formed so as to be curved in the form of a meander line structure.

A fractal antenna for a vehicle according to a further embodiment of the present invention includes substrates 110*a* and 110*b*, which are downwardly inclined from an apex ridge and are disposed opposite each other on the left and right sides; substrates 210*a* and 210*b*, which are downwardly inclined from an apex ridge and are disposed opposite each other on the left and right sides in an inner space formed by the substrates 110*a* and 110*b* and having the same shape as the substrates 110*a* and 110*b*; pattern units 100*a*, 100*b*, 200*a*, and 200*b*, which have predetermined shapes and are formed on the respective outer surfaces of the substrates 110*a*, 110*b*, 210*a*, and 210*b*; a feed unit 130, which applies signals to the pattern units 100*a*, 100*b*, 200*a*, and 200*b*; and a radome 300, which protects the pattern units 100*a*, 100*b*, 200*a*, and 200*b*. The substrates 110*a*, 110*b*, 210*a*, and 210*b* are disposed inside the radome 300 so that a central axis between the substrates 110*a* and 110*b*, which are downwardly inclined from the apex ridge and are disposed opposite each other on the left and right sides, and a central axis between the substrates 210*a* and 210*b*, which are downwardly inclined from the apex ridge and are disposed opposite each other on the left and right sides, is perpendicular to the mounting surface of the vehicle.

The operations and configurations of the fractal antenna for a vehicle according to this embodiment of the present invention are almost the same as those of the fractal antenna for a vehicle according to the second embodiment, and only the fact that the radome 300 for protecting the patterns 100*a*, 100*b*, 200*a*, and 200*b* is further included is different from the fractal antenna for a vehicle according to the second embodiment.

Therefore, the present invention has an advantage in that the first and second parasitic elements 200*a* and 200*b* are disposed in an inner space formed by the first and second radiation elements 100*a* and 100*b*, so that the radiation elements and the parasitic elements are connected to each other in a coupling fashion, with the result that compensation is performed on a capacitance value 'C', thereby generating broadband resonance frequencies.

Further, the fractal antenna for a vehicle according to the present invention provides an omnidirectional antenna in which the first and second radiation elements 100*a* and 100*b* are disposed opposite each other on the left and right sides, so that signal attenuation is small in all directions.

In addition, the fractal antenna for a vehicle according to the present invention uses a fractal structure pattern, so that space efficiency is improved, thereby providing an antenna of reduced size.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A fractal antenna for a vehicle, comprising:

first and second radiation elements downwardly inclined from an apex ridge and disposed opposite each other on left and right sides inside a radome for protecting the antenna; and first and second parasitic elements formed in an inner space formed by the first and second radiation elements, disposed to be parallel to and spaced apart from the respective first and second radiation elements at regular intervals, downwardly inclined from an apex ridge, and disposed opposite each other on left and right sides.

2. The fractal antenna for a vehicle as set forth in claim 1, wherein:

the first and second radiation elements are respectively formed on part of an upper surface of one side of a first substrate and part of an upper surface of one side of a second substrate in patterns each having a predetermined shape, each of the first and second substrates being formed to have a predetermined size; and the first and second radiation elements are electrically connected to each other.

3. The fractal antenna for a vehicle as set forth in claim 2, wherein:

the first radiation element is provided with a feed unit configured to apply signals at one end thereof; and the second radiation element is provided with an open end at one end thereof.

4. The fractal antenna for a vehicle as set forth in claim 2, wherein the patterns of the first and second radiation elements each having the predetermined shape are each formed in such a way that a Koch curve fractal is periodically iterated.

5. The fractal antenna for a vehicle as set forth in claim 2, wherein the first and second radiation elements are downwardly inclined from the apex ridge and are disposed opposite each other on the left and right sides.

6. The fractal antenna for a vehicle as set forth in claim 2, wherein a basic resonant frequency is adjusted based on the total length and width of the patterns, which form the first and second radiation elements.

7. The fractal antenna for a vehicle as set forth in claim 6, wherein the fractal antenna is operated in a Digital Multimedia Broadcasting (DMB) broadcast reception band or an Amplitude Modulation/Frequency Modulation (AM/FM) broadcast reception band based on the total length of the patterns, which form the first and second radiation elements.

8. The fractal antenna for a vehicle as set forth in claim 4, wherein the first and second radiation elements are formed so as to be curved in a meander line structure when the lengths of fractal structure patterns, which form the first and second radiation elements, are longer than respective lengths of the first and the second substrates.

9. The fractal antenna for a vehicle as set forth in claim 1, wherein:

the first and second parasitic elements are respectively formed on part of an upper surface of one side of a third substrate and part of an upper surface of one side of a fourth substrate in patterns each having a predetermined shape, each of the third and fourth substrates being formed to have a predetermined size; and the first and second parasitic elements are electrically connected to each other.

10. The fractal antenna for a vehicle as set forth in claim 9, wherein the first parasitic element is connected to the first radiation element in a coupling fashion, and the second parasitic element is connected to the second radiation element in a coupling fashion, thereby generating broadband resonant frequencies.

11. The fractal antenna for a vehicle as set forth in claim 9, wherein the patterns of the first and second parasitic elements each having the predetermined shape are each formed in such a way that the a Koch curve fractal is periodically iterated.

12. The fractal antenna for a vehicle as set forth in claim 1, wherein:

the first and second radiation elements are respectively formed on part of an upper surface of one side of a first substrate and part of an upper surface of one side of a second substrate in patterns each having a predetermined shape, each of the first and second substrates being formed to have a predetermined size and the first and second radiation elements being electrically connected to each other; and the first and second parasitic elements are respectively formed on part of an upper surface of one side of a third substrate and part of an upper surface of one side of a fourth substrate in patterns each having a predetermined shape, each of the third and fourth substrates being formed to have a predetermined size and the first and second parasitic elements being electrically connected to each other.

13. The fractal antenna for a vehicle as set forth in claim 1, wherein a central axis between the first and second radiation elements, which are downwardly inclined from the apex ridge and are disposed opposite each other on the left and right sides, and a central axis between the first and second parasitic elements, which are downwardly inclined from the apex ridge and are disposed opposite each other on the left and right sides, are disposed upright so that the central axes are perpendicular to a mounting surface of the vehicle.

14. A fractal antenna for a vehicle comprising:

four substrates including two pairs of substrates, a first pair of substrates being downwardly inclined from an apex ridge and disposed opposite each other on left and right sides, and a second pair of substrates being downwardly inclined from an apex ridge and disposed opposite each other on left and right sides;

pattern units formed on respective outer surfaces of the substrates; and a feed unit configured to apply signals to the pattern units.

15. The fractal antenna for a vehicle as set forth in claim 14, wherein the four substrates, the pattern units, and the feed unit are disposed inside a radome for protecting the antenna so that a central axis between the first pair of substrates, which are downwardly inclined from the apex ridge and are disposed opposite each other on the left and right sides, and a central axis between the second pair of substrates, which are downwardly inclined from the apex ridge and are disposed opposite each other on the left and right sides, are perpendicular to a mounting surface of the vehicle.

16. The fractal antenna for a vehicle as set forth in claim 14, wherein:

the first pair of substrates comprise outwardly disposed first and second substrates and the second pair of substrates comprise inwardly disposed third and fourth substrates; and the pattern units comprise first and second radiation elements, which are formed on the respective first and second substrates in such a way that a Koch curve fractal is periodically iterated, and are configured to radiate electromagnetic waves, and first and second parasitic elements, which are formed on the respective third and fourth substrates in such a way that a Koch curve fractal is periodically iterated and are connected to the respective first and second radiation elements in a coupling fashion.

17. The fractal antenna for a vehicle as set forth in claim 16, wherein a basic resonant frequency is adjusted based on a total length and a width of the patterns, which form the first and second radiation elements.

18. The fractal antenna for a vehicle as set forth in claim 17, wherein the fractal antenna is operated in a DMB broadcast reception band or an AM/FM broadcast reception band based on the total length of the patterns, which form the first and second radiation elements.

19. The fractal antenna for a vehicle as set forth in claim 16, wherein the first and second radiation elements are formed so as to be curved in a meander line structure when the lengths of fractal structure patterns, which form the first and second radiation elements, are longer than respective lengths of the first and the second substrates.

20. A fractal antenna for a vehicle comprising:

four substrates including two pairs of substrates, a first pair of substrates being downwardly inclined from an apex ridge and disposed opposite each other on left and right sides, and a second pair of substrates being downwardly inclined from an apex ridge and disposed opposite each other on left and right sides;

pattern units configured to have respective predetermined shapes, and formed on respective outer surfaces of the substrates;

a feed unit configured to apply signals to the pattern units; and a radome configured to protect the pattern units;

wherein the four substrates are disposed inside the radome so that a central axis between the first pair of substrates, which are downwardly inclined from an apex ridge and are disposed opposite each other on left and right sides, and a central axis between the second pair of substrates, which are downwardly inclined from an apex ridge and are disposed opposite each other on the left and right sides, are perpendicular to a mounting surface of the vehicle.

21. The fractal antenna for a vehicle as set forth in claim 20, wherein:

the first pair of substrates comprise outwardly disposed first and second substrates and the second pair of substrates comprise inwardly disposed third and fourth substrates; and the pattern units comprise first and second radiation elements, which are formed on the respective first and second substrates in such a way that a Koch curve fractal is periodically iterated, and are configured to radiate electromagnetic waves, and first and second parasitic elements, which are formed on the respective third and fourth substrates in such a way that a Koch curve fractal is periodically iterated and are connected to the respective first and second radiation elements in a coupling fashion.

22. The fractal antenna for a vehicle as set forth in claim 21, wherein a basic resonant frequency is adjusted based on a total length and a width of the patterns, which form the first and second radiation elements.

23. The fractal antenna for a vehicle as set forth in claim 22, wherein the fractal antenna is operated in a DMB broadcast reception band or an AM/FM broadcast reception band based on the total length of the patterns, which form the first and second radiation elements.

24. The fractal antenna for a vehicle as set forth in claim 21, wherein the first and second radiation elements are formed so as to be curved in a meander line structure when the lengths of fractal structure patterns, which form the first and second radiation elements, are longer than respective lengths of the first and the second substrates.

* * * * *